United States Patent [19]

Mena

[11] 4,343,128

[45] Aug. 10, 1982

[54] METHOD AND CIRCULAR TRANSFER APPARATUS FOR AUTOMATIZED CONDITIONING OF PHARMACEUTICAL PHIALS

[75] Inventor: Edouard Mena, Marseilles, France

[73] Assignee: Publimepharm, Monte-Carlo, Monaco

[21] Appl. No.: 188,145

[22] Filed: Sep. 17, 1980

[30] Foreign Application Priority Data

Sep. 21, 1979 [FR] France ..... 79 23639

[51] Int. Cl.[3] ..... B65B 17/00

[52] U.S. Cl. ..... 53/167; 53/266 R; 134/152; 141/86; 141/89; 141/234; 141/129

[58] Field of Search ..... 141/1, 4–8, 141/37–67, 85–93, 234–248, 250–284, 129–191, 115–127; 53/403–408, 425, 477, 167, 266 R; 134/152, 166 R, 171

[56] References Cited

U.S. PATENT DOCUMENTS 3,277,929 10/1966 Cook ..... 141/113

3,563,287 2/1971 Ruddick ..... 141/113

FOREIGN PATENT DOCUMENTS 1128044 1/1957 France .

*Primary Examiner*—Houston S. Bell, Jr.

*Attorney, Agent, or Firm*—Cushman, Darby & Cushman

[57] ABSTRACT

The apparatus comprises a rotating plate directly coupled to the shaft of the driving motor and carrying phial holding and handling devices selectively actuatable to be rotated between upward and downward positions around their radial shafts. The filling and cleaning stations of the apparatus include small-sized pans releasably mounted on sliding pan-supporting devices, upward displacement of the pans to bring same into sealing contact engagement with the cover plate of the phial holding devices and downward displacement of said pans being achieved by a double-action cylinder, the end of the cylinder rod of which selectively comes into sealing bearing engagement with a shaped draining opening formed in the bottom of the pan.

11 Claims, 3 Drawing Figures

METHOD AND CIRCULAR TRANSFER APPARATUS FOR AUTOMATIZED CONDITIONING OF PHARMACEUTICAL PHIALS

FIELD OF THE INVENTION

The present invention relates to a method and an apparatus for automatically conditioning pharmaceutical phials or sealed small glass containers, and more particularly a circular transfer apparatus for automatically and sequentially accomplishing at high operating rates the different steps of conditioning pharmaceutical phials.

BACKGROUND OF THE INVENTION

Circular transfer apparatus are known, which comprise a rotating plate at the periphery of which are mounted devices for holding and handling ordered sets of phials and adapted to be brought to different conditioning stations where operators manually carry out successive operations for handling and conditioning the phials. Such an apparatus is disclosed in French Pat. No. 1,128,044. Said apparatus does not permit to achieve automatic operation at high operating rates and therefore requires numerous and skilled operators. Automatized apparatus are also known which comprise means for accomplishing, at the related stations, a reversal of the devices for holding and handling the sets of phials as well as for actuating the related devices for successively raising and lowering the assembly comprising the rotating table and said holding and handling devices so as to selectively bring the sets of phials in immersed position within the stationary conditioning pans. Such an apparatus however shows structural and functional complexity, more particularly as concerns the power transmission between the rotating table and the driving motor, as also sealing and centering difficulties at the interface between the phials holding and handling devices and the conditioning pans.

SUMMARY OF THE INVENTION

There is an object of the invention to provide a method of conditioning pharmaceutical phials or the like on a rotating transfer apparatus operated in an automatic mode, which essentially permits to simplify the conditioning units while making same more reliable and allowing increased production rates.

There is another object of the invention to provide an improved circular transfer apparatus which is reliable and of reduced manufacturing costs and which further permits to multiplicate the conditioning stations without inducing substantial structural or operating measures nor noticeable extra costs for the whole apparatus.

The method of the invention employs a circular transfer apparatus comprising a frame, a rotating plate mounted on said frame for rotation in a substantially horizontal plane around a vertical axis, a plurality of conditioning stations angularly spaced on the periphery of the plate and extending radially outwardly therefrom, controllable reverting means for selectively rotating the rotating plate, at least a means for individually controllably rotating the phial holding and handling devices around a radial direction and, at cleaning and filling stations, a pan supporting device adapted to be vertically displaced sequentially with the means for rotating the plate and the means for reversing the holding and handling devices.

According to a feature of the invention, the automatized conditioning method of the invention employing such a rotating transfer apparatus comprises the steps of bringing, at said cleaning and filling stations, the corresponding conditioning pan in a raised position around the sets of phials supported in their downwardly extending position by the phial holding and handling device through a vertical displacement of the pan in said raised position, accomplishing the operations of cleaning and/or filling the phials, of lowering the conditioning pan, of draining same and of displacing, through a rotation of the plate in its stationary rotating plane, the set of phials toward a subsequent conditioning station adjacent said rotating plate.

According to a preferred embodiment of the invention, the steps of sealing and draining the conditioning pan are achieved automatically during the raising and lowering phases of the pan, respectively, by means of a double action cylinder, the rod of which has its free end coming into selective bearing engagement with a seat-forming draining opening formed in the bottom of the pan.

According to the invention, the relative displacement of the pans and of the set of phials at said cleaning and filling stations is achieved by raising or lowering the related pans only at said stations where such an operation is required, the raising and lowering of the concerned pans being achieved by a double action cylinder which further ensures, during the raising step, a controllable sealing between the upper peripheral surface of the pan and the mating lower face of the support plate of the device for holding and handling the set of phials, and, during the lowering step, adjacent the end of downward travel of the pan, automatic draining of the pan through a large dimensioned opening, whereby eliminating the usual additional siphoning means and the additional means for locking and unlocking the pans in operative position.

BRIEF DESCRIPTION OF THE DRAWINGS

Other features and advantages of the invention will become apparent from the following description and accompanying drawings in which.

DETAILED DESCRIPTION OF THE DRAWINGS

Figure 3:
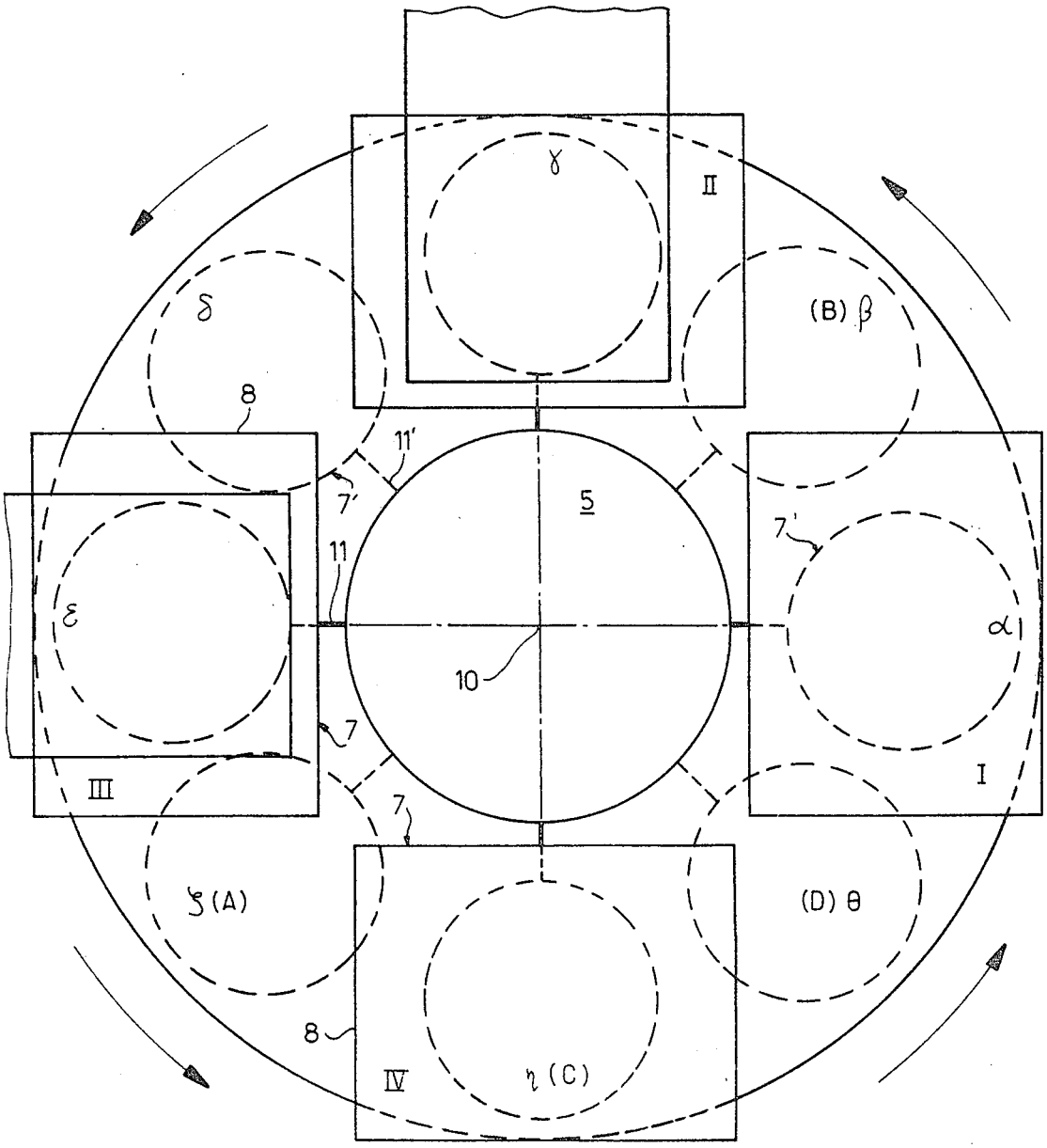
FIG. 3 is a schematic view depicting the different possibilities of installing conditioning stations in the apparatus of FIGS. 1 and 2.

As illustrated in the drawings, the apparatus of the invention comprises a cage frame 1 mounted on a mounting base 2 and supporting, at its upper end, a stationary support plate 3 which supports a depending electric motor 4 for driving a rotating transfer plate 5 which is advantageously directly keyed on the shaft 6 of the motor. On the rotating plate 5 are mounted, adjacent the periphery thereof, a plurality of devices for holding and handling sets of phials, which are generally designated by reference 7 and which are angularly spaced around the plate 5 to correspond to the chosen number of conditioning stations of the apparatus. In FIG. 3 there are illustrated in full lines and in quadrangular outlines four such devices for an apparatus having four conditioning stations and, in dotted lines and rounded outlines, eight devices for an apparatus having eight conditioning stations, as it will be seen hereinbelow.

Figure 1:
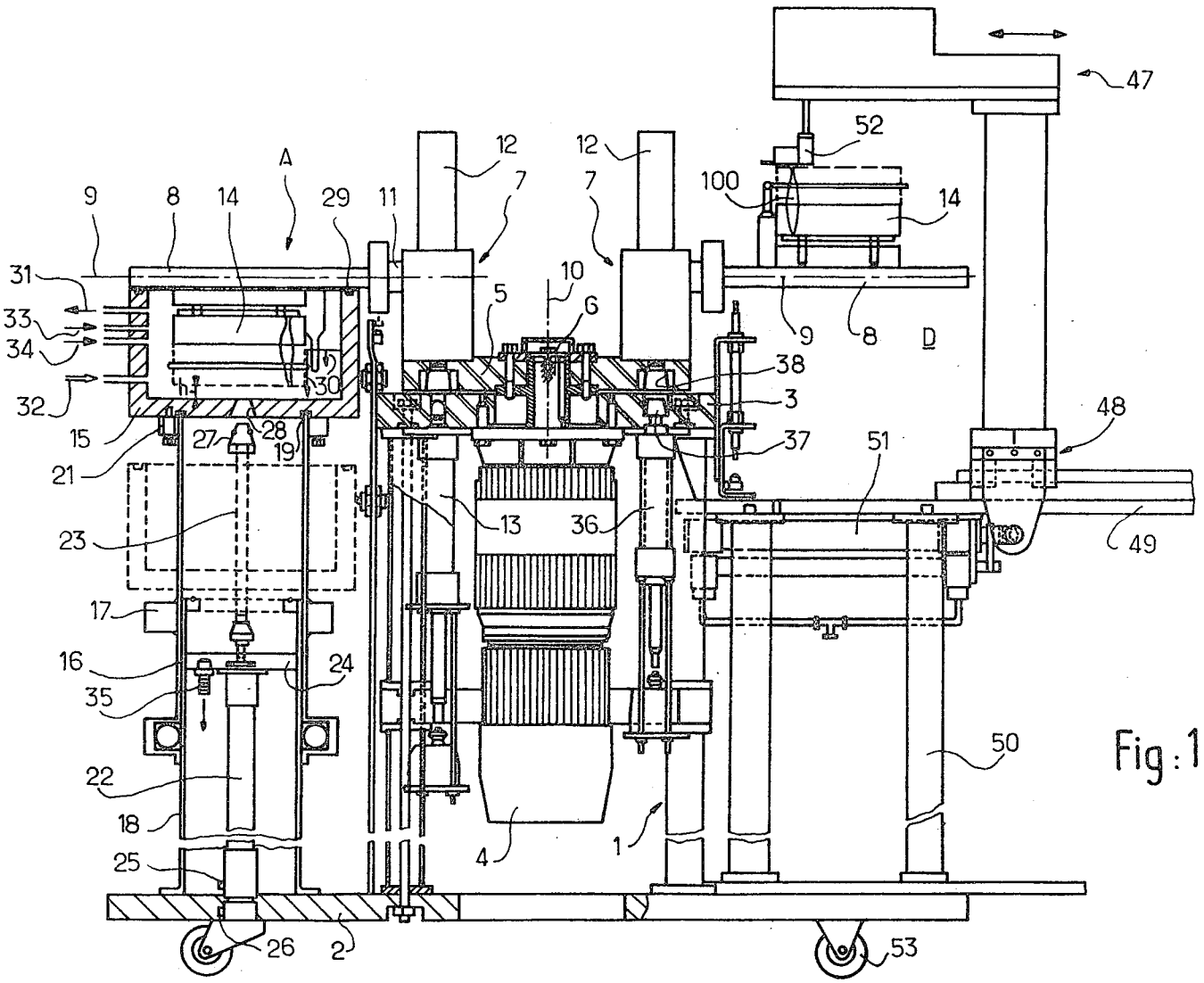
FIG. 1 is a schematic elevational view, partially in cross section, of an apparatus according to the invention.
Figure 2:
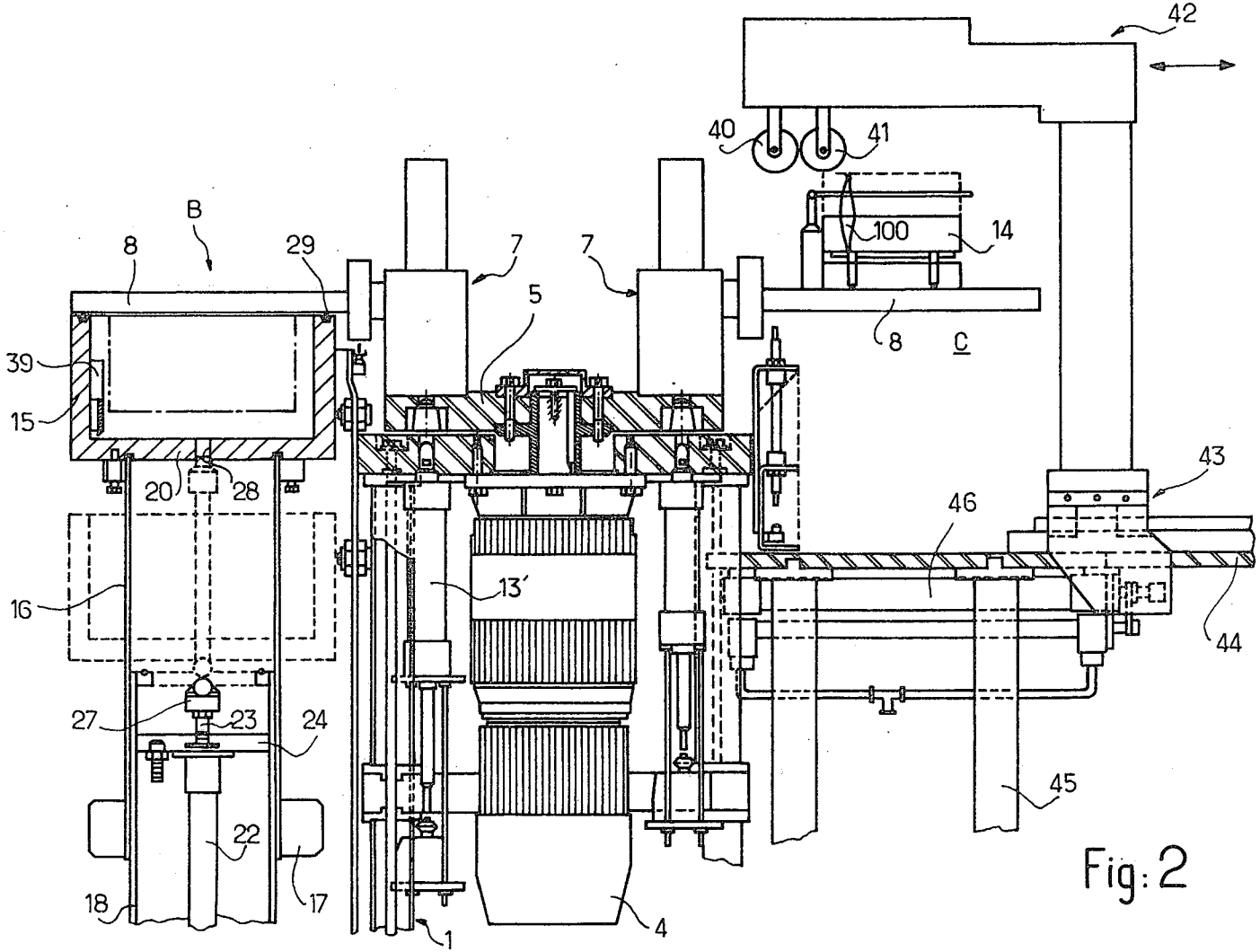
FIG. 2 is a view similar to FIG. 1 but showing two other diametrally opposed conditioning stations.

As best seen in FIGS. 1 and 2, each phial holding and handling device 7 comprises, extending radially outwardly from the plate 5, a platen 8 having two opposite parallel plane faces and mounted for rotation around a median axis 9 extending in a radial direction of the rotating plate to be selectively reversed from 180° so as to adopt two horizontal positions which are opposite around the horizontal radial axis 9 which extends perpendicular to the vertical axis 10 of the rotating plate 5 by means of a shaft 11 having its inner end meshing with a vertical rack means 12 selectively actuated by cylinders 13,13' mounted at given angular positions on the stationary frame 1 and extending through opening cognately formed in the rotating plate 3. Each platen 8 is equipped, on a face thereof, with a supporting device 14 for supporting and holding two phial-rack supports 100. In FIGS. 1 and 2 the phial holding and handling devices 7 are shown in the lowered position at the left conditioning station and in the raised position at the right conditioning station. In said Figures, the left conditioning stations are for example a filling station A and a cleaning station B, respectively.

According to the invention, each one of said stations A and B includes a conditioning pan 15 of reduced and identical dimensions which are adapted to the overall size of the phial-racks. Each pan 15 is detachably secured to the upper end of a cylindrical shroud 16 mounted for vertical sliding displacement, for instance by means of ball rings 17, on a stationary hollow cylindrical column 18 secured to the mounting base 2. The upper peripheral edge of the pan supporting shroud 16 is received within an annular slot 19 formed in the bottom 20 of the pan 15, a screw setting means 21 being provided for adjusting convenient trueness of the pan. Extending co-axially within the column 18 is mounted a double-rod double action cylinder means 22, the outer or upper rod 23 of which may extend co-axially within the shroud 16 up to the bottom 20 of the pan 15. The cylinder means 22 is supported on a liquid-tight transversal wall 24 within the column 18 and comprises, adjacent its lower end, inlets 25 and 26 for connection of the cylinder sections to hydraulic control circuits.

According to the invention, the free end of the cylinder rod 23 is terminated by a shaped obturing head 27 arranged to come in selective sealing bearing engagement with a corresponding shaped opening 28 formed in the bottom 20 of pan 15. In the preferred embodiment illustrated in FIG. 1, the thrust and obturating head 27, provided with a peripheral O-ring, has a frustoconical shape as also correspondingly the opening 28 when, in the embodiment illustrated in FIG. 2, the operating head is terminated by a ball adapted for cooperation with a cylindrical seat or opening 28 formed in the bottom of the pan. It will be understood that, with such an arrangement, actuation of the cylinder means 22 permits, as a result of an extension of the cylinder rod 23, first to bring the head 27 in bearinng engagement with the shaped opening 23, whereby sealingly obturating same for preventing losses or escape of the liquids within the pan through said opening, and, by continuing said upward extension, to effect raising of the pan and of the associated shroud 16 till the upper edge of the pan comes into bearing engagement with the lower face of the cover platen 8 of the phial holding and handling device 7. A seal ring 29 is accordingly provided on the upper edge of the pan 15. There is thus achieved, with a low power cylinder, a convenient sealing and a self-centering effect of the pan against the cover platen 8 without exerting upon said latter and, accordingly on the connected actuating rack, noticeable forces, as opposed to what happens, for instance, in a transfer apparatus embodying a vertically displaceable rotating plate. Additionally, in the arrangement of the invention, when a vacuum is created within the pan 15, the seal 29 is further compressed, whereby improving sealing while further inducing a corresponding pulling of the obturating head and of the cylinder rod 23 which on the other hand also contributes to improve sealing in the bottom of the pan, at the level of the opening 28.

According to the invention, each conditioning pan 15 designed to contain a conditioning liquid comprises a constant level device having upper and lower probes 30, and is connected through flexible pipes to a vacuum pump, as figurated by the arrow 31, and to a conditioning liquid feeding circuit, as figurated by the arrow 32, the pan further comprising two differentially sized flow air inlets 33 and 34. In order to improve reliability and synchronism of the apparatus, the rods of the cylinders 13 for actuating the toothed racks 12 of the phials holding and handling devices 7 selectively cooperate with limit switches to prevent a rotation of the driving motor 4 when said racks are actuated. Correlatively, on a rotating part of the rotating mechanism of the phial-supporting platen 8 there is provided a pointer which, when the phial-supporting platen is rotated, actuates a switch, as schematically illustrated at the left stations in FIGS. 1 and 2. When a filling or a cleaning step is accomplished, i.e. generally when the pan has been filled up with a convenient liquid up to the required level, and after depressurization of the pan and two-stepped recompression of said pan, the cylinder rod 23 is retracted, whereby permitting lowering of the pan 15 and its associated shroud 16 by their own weight, so as to make free the concerned phial holding and handling device for ulterior reversal towards a raised condition. When the pan reaches its lowermost position in abutment against a corresponding stop (not shown), as illustrated in dotted lines in FIGS. 1 and 2, further retractation of the cylinder rod 23 causes the head 27 to be separated from the opening 28 in the bottom of the pan 15, thus allowing a quick draining of the pan through said opening 28 which is conveniently widely calibrated to generate in the pan a vortex which causes the particles within the conditioning liquid in the pan to be swept along by the draining flow of the liquid which is finally exhausted by a conduit only illustrated by its fitting 35 mounted in the transversal wall 24 in the column 18. The treated phials may thus be displaced towards the following conditioning station with the associated holding and handling devices eventually previously rotated in their upwardly extending position. The apparatus further comprises registering cylinders 36 mounted on the frame 1, the rods of which are terminated by a shaped head 37 for cooperation with corresponding openings 38 formed in the rotating plate 5 so as to achieve a convenient angular setting of the rotating plate corresponding to the positions required for the phials holding and handling devices in mating relationship with the corresponding conditioning stations around the rotating plate.

Among said conditioning stations, there are illustrated, in FIG. 2, a cleaning station B which is similar, according to pharmaceutical practice, to the filling station A, i.e. includes pipes for connection to vacuum and filling circuits, but which further advantageously comprises, inside the pan 15, a device 39 for generating ultrasonics. There is also illustrated in FIG. 2 a station C for cleaning the open slender ends of the phials 100 which have been previously cleaned and filled with the liquid to be stored and which comprises a cleaning unit including a set of two sponge rolls 40 and 41 fed with hot and cold water, respectively, and carried by a cleaning head 42 secured to a carriage 43 which is selectively displaceable in to-and-fro movement on a horizontal radially extending slide 44 supported by means of post 45 on the mounting base 2 of the apparatus. The carriage and the appended cleaning head 42 are radially displaced in a to-and-fro movement by means of a double action cylinder 46, follow-up or proximity detectors being provided on the path of the carriage 43 to selectively actuate the cylinder 46 for controllably displacing the carriage.

Similarly, there is illustrated in FIG. 1, a closing or a welding head 47 carried by a carriage 48 mounted for to-and-fro sliding displacement in the radial direction on a rail 49 supported by posts 50 and controllably displaced by a double-action cylinder 51 to cause a welding torch 52 to be displaced in a to-and-fro movement adjacent and above the slender ends of the filled phials 100 for sealingly closing said latter.

There is illustrated in full lines in FIG. 3 a four-station rotating apparatus which comprises, successively, a loading-unloading station I, a cleaning/filling station II, a sealing station III and a closed phial sealing control station IV. The modular arrangement of the apparatus according to the invention, more particularly as concerns the possibility of multiplying around a given rotating plate 5 the conditioning stations with corresponding raising cylinder means for the specific pan of the considered station, allows utilization of standard pans, advantageously all identical, and permits eventually easy interchange of the stations, more particularly the cleaning, filling or sealing control stations. As concerns said sealing control station, sealing control may be achieved in a filling pan by merely actuating the vacuum pump of the vacuum circuit, so as to detect a possible leakage for identifying the non-sealingly closed phials, the exhaust of the leakage being accomplished exactly as the normal draining of the cleaning or filling liquid from the pan. There is illustrated in dotted lines in FIG. 3 an eight-station apparatus having eight conditioning stations $\alpha$ to $\theta$, i.e., successively, a loading/unloading station which is common to the preceding embodiment and which is the only station requiring an operator for the apparatus, a first filling and cleaning station, a first draining station, a second filling and cleaning station, a second draining station, the proper filling station, the station for cleaning the ends of the filled phials, the sealing station and the vacuum control station.

The apparatus of the invention allows utilization of conditioning pans having minimal dimensions, i.e. defining an inner space which is only slightly greater than the overall bulk or the phial-racks, the height h (FIG. 1) between the lowermost end of the phials in their downwardly extending position and the bottom of the pan being for instance of about 5 mm. Said feature, in addition to the possible miniaturization of all the constitutive integers by reason of the suppression of a rotating plate mounted for upward and downward displacement, permits to build the apparatus in the form of a displaceable apparatus with wheels 53 mounted on the bottom of the mounting base 2. The driving motor 4 as also its switch-actuated electronic control system may be further advantageously designed to be operated under a low voltage of 24 volts.

Although the invention has been disclosed in relation with a preferred embodiment, obviously many modifications and variations of the invention are possible in light of the above teachings, without departinng from the scope of the appended claims.

What I claim is:

1. A rotating transfer apparatus for automated conditioning of pharmaceutical phials, which comprises:

a frame;

a plate member supported on said frame so as to be rotatable around a vertical axis;

a plurality of phial conditioning stations angularly spaced on the periphery of said rotating plate member and including at least a cleaning station and a filling station each provided with an associated conditioning pan having a bottom and an opening and adapted to contain at least momentarily a liquid for cleaning or filling said phials;

a plurality of angularly spaced devices for holding and handling sets of phials mounted on said rotating plate member and extending radially outwardly therefrom;

a controllable driving means for selectively rotating said rotating plate member;

means for controllably rotating individually said phial holding and handling devices at selected said stations around a horizontal axis extending in a radial direction so as to introduce at least partially said associated phials in a said conditioning pan, further including, at each one of said phial cleaning and filling stations, a pan supporting device onto which is releasably mounted an associated said pan and which is vertically displaceable sequentially with said means for rotating said rotating plate member and said means for rotating said phial holding and handling devices;

each said pan supporting device comprising:

a cylindrical shroud, the upper end of which is adapted to be connected to said bottom of the associated said conditioning pan, said shroud being mounted for sliding displacement on a stationary vertical support connected to said frame;

a double action cylinder means connected to said stationary support in coaxial relationship with said shroud and having one cylinder rod end terminated by an obturating and bearing head adapted to selectively come into bearing engagement with a draining opening formed in said bottom of said conditioning pan, said draining opening being shaped so as to define a fluidtight bearing seat for said operating head, and draining means associated with said shroud.

2. The apparatus according to claim 1, wherein said phial holding and handling devices each comprises:

a phial-rack supported on a shaft extending radially outwardly overhung from said rotating plate and rotatable around a radial axis by a driving rack-device mounted on said rotating plate;

a cover platen integral with said shaft and having two opposite faces, the upper end of said pans comprising a seal arranged for contact engagement with a said face of said cover when said pan is raised in its upper position against said cover platen;

cylinder means angularly spaced on said frame to correspond to said cleaning and filling stations for selectively actuating said rack-devices at said stations.

3. The apparatus of claim 2, further comprising registering and angular setting cylinder means on said frame adapted for cooperation with corresponding recesses formed in said rotating plate.

4. The apparatus according to claim 1, wherein to each said conditioning pan is associated a circuit for selectively feeding conditioning fluid within said pan and air and vacuum circuits selectively actuatable in mutual synchronism and in synchronism with the rotating plate and the displacement of said pan supporting devices.

5. The apparatus according to claim 4, wherein said circuits are connected to a high-and-low level control device arranged within said pan.

6. The apparatus according to claim 1, comprising a station for cleaning the ends of the phials in said set of phials, which includes a pair of sponge rolls adapted for displacement in a to-and-fro movement in the radial direction.

7. The apparatus of claim 6, which comprises a station for sealingly closing the ends of the filled phials, including a welding torch adapted for displacement in a radial to-and-fro movement.

8. The apparatus according to claim 7, further comprising, successively, at least a pair of filling/cleaning and draining stations.

9. The apparatus of claim 8, further comprising a station for sealing control of sealed filled phials, including a said pan connected to said air and vacuum circuits and supported by a said pan supporting device.

10. The apparatus of claim 1, including an electronically controlled electric motor supported on said frame, and wherein said rotating plate is directly coupled to the shaft of said motor.

11. The apparatus according to claim 1 wherein said frame is supported on a displaceable mounting base.

* * * * *